US011136209B2

(12) United States Patent
Hu et al.

(10) Patent No.: US 11,136,209 B2
(45) Date of Patent: Oct. 5, 2021

(54) FEED MODULE

(71) Applicant: Kinpo Electronics, Inc., New Taipei (TW)

(72) Inventors: Kai-Hong Hu, New Taipei (TW); Hung-Huan Sung, New Taipei (TW)

(73) Assignee: Kinpo Electronics, Inc., New Taipei (TW)

( * ) Notice: Subject to any disclaimer, the term of this patent is extended or adjusted under 35 U.S.C. 154(b) by 151 days.

(21) Appl. No.: 16/568,269

(22) Filed: Sep. 12, 2019

(65) Prior Publication Data

US 2020/0407182 A1 Dec. 31, 2020

(30) Foreign Application Priority Data

Jun. 26, 2019 (CN) ..... 201910561539.7

(51) Int. Cl.
*B65H 7/14* (2006.01)
*B65H 1/04* (2006.01)

(52) U.S. Cl.
CPC ..... *B65H 7/14* (2013.01); *B65H 1/04* (2013.01); *B65H 2511/11* (2013.01); *B65H 2511/12* (2013.01); *B65H 2553/30* (2013.01); *B65H 2553/41* (2013.01)

(58) Field of Classification Search
CPC ... B65H 1/04; B65H 7/00; B65H 7/02; B65H 7/14; B65H 2405/114; B65H 2405/1144; B65H 2511/00; B65H 2511/10; B65H 2511/11; B65H 2511/12; B65H 2511/22; B65H 2553/30; B65H 2553/40;
(Continued)

(56) References Cited

U.S. PATENT DOCUMENTS 5,511,771 A * 4/1996 Rubscha ..... B65H 1/04 271/171
5,946,527 A * 8/1999 Salgado ..... H04N 1/00713 399/82

(Continued)

FOREIGN PATENT DOCUMENTS

| | | |
|---|---|---|
| JP | H07300243 | 11/1995 |
| JP | 2016050116 | 4/2016 |
| JP | 2016210559 | 12/2016 |

OTHER PUBLICATIONS

Office Action of Japan Counterpart Application, dated Feb. 9, 2021, pp. 1-4.

*Primary Examiner* — Prasad V Gokhale
(74) *Attorney, Agent, or Firm* — JCIPRNET

(57) ABSTRACT

The present disclosure provides a feed module, which is applicable to an electronic device, for example, a multi-function product/printer/peripheral or printer and the like. The feed module comprises a carrier tray, a clamping piece, a first sensor and a control unit. A document is suitable for being placed on the carrier tray, and is driven by the feed module to be transferred into the multi-function product/printer/peripheral or printer. The clamping piece is movably assembled on the carrier tray. The first sensor senses the position of the clamping piece on the carrier tray. The control unit is electrically connected with the first sensor. After the document is placed on the carrier tray and clamped by the clamping piece, the control unit determines the width of the document by the first sensor.

8 Claims, 5 Drawing Sheets

(58) Field of Classification Search
CPC ..... B65H 2553/41; B65H 2553/412; B65H 2553/414; B65H 2553/416
See application file for complete search history.

(56) References Cited

U.S. PATENT DOCUMENTS

| | | | | |
|---|---|---|---|---|
| 2011/0013240 | A1* | 1/2011 | Kobayashi | H04N 1/0035 358/498 |
| 2011/0169215 | A1* | 7/2011 | Oh | B65H 1/266 271/227 |
| 2016/0059593 | A1* | 3/2016 | Otsuka | B65H 1/266 347/16 |
| 2020/0039770 | A1* | 2/2020 | Chiang | H04N 1/0057 |
| 2020/0301339 | A1* | 9/2020 | Nagata | B65H 29/52 |

* cited by examiner

| Specification | Size (mm) | 110 | 120 | 130 | Specification | Size (mm) | 110 | 120 | 130 |
|---|---|---|---|---|---|---|---|---|---|
| A3 SEF | 297x420 | 20.5 | ● | ● | A4 LEF | 297x210 | 20.5 | ● | |
| LD SEF | 279x432 | 29.5 | ● | ● | LT LEF | 279x216 | 29.5 | ● | |
| B4 SEF | 250x353 | 44 | ● | ● | B5 LEF | 250x176 | 44 | | |
| LG SEF | 216x356 | 61 | ● | ● | ST_R LEF | 216x140 | 61 | | |
| LT SEF | 216x279 | 61 | ● | | A5 LEF | 210x148 | 64 | | |
| A4 SEF | 210x297 | 64 | ● | ● | B6 LEF | 176x125 | 81 | | |
| B5 SEF | 176x250 | 81 | ● | | A6 LEF | 148x105 | 95 | | |
| A5 SEF | 148x210 | 95 | ● | | | | | | |
| ST_R SEF | 140x216 | 99 | ● | | | | | | |
| B6 SEF | 125x176 | 106.5 | | | | | | | |
| A6 SEF | 105x148 | 116.5 | | | | | | | |

FIG. 4

FEED MODULE

CROSS-REFERENCE TO RELATED APPLICATION

This application claims the priority benefit of China application serial no. 201910561539.7, filed on Jun. 26, 2019. The entirety of the above-mentioned patent application is hereby incorporated by reference herein and made a part of this specification.

BACKGROUND

1. Technical Field

The present disclosure relates to a feed module applicable to a multi-function product/printer/peripheral or printer.

2. Description of Related Art

Most of generally used electronic devices with a paper feeding function, for example a multi-function product/printer/peripheral or printer, are incapable of providing a recognition means for the size of paper, that is, an existing auto document feeder (ADF) takes paper with maximal size as the data transmission basis.

However, along with the diversification of the size of paper, if still taking the foregoing maximal paper as a basis, the situation that the operation efficiency is reduced due to waste of processing time will be caused obviously.

Accordingly, how to increase the sensing efficiency of the multi-function product/printer/peripheral or printer and the like for the size of paper and enable the multi-function product/printer/peripheral or printer and the like to determine the size of the paper in advance with proper structure and configuration so as to adopt a means capable of handling the size to perform data transmission to increase the operation efficiency are issues needing to be thought and solved by related technicians.

SUMMARY

The present disclosure relates to a feed module aiming at a multi-function product/printer/peripheral or printer and the like, which is capable of completing recognition to the size and specification of the document when the document is placed on the feed module.

According to the embodiment of the present disclosure, the feed module includes a carrier tray, a clamping piece, a first sensor and a control unit. A document is suitable for being placed on the carrier tray, and is driven by the feed module to be transferred into the multi-function product/printer/peripheral or printer. The clamping piece is movably assembled on the carrier tray. The first sensor senses the position of the clamping piece on the carrier tray. The control unit is electrically connected with the first sensor. After the document is placed on the carrier tray and clamped by the clamping piece, the control unit determines the width of the document by the first sensor.

In the feed module according to the embodiment of the present disclosure, the first sensor is a distance sensor, and the feed module further includes a storage unit for storing a corresponding relation between the relative distance of the first sensor and the clamping piece and the position of the clamping piece on the carrier tray.

In the feed module according to the embodiment of the present disclosure, the first sensor is an optical sensor, and faces the clamping piece. The optical sensor generates and transmits light to the clamping piece and receives light reflected by the clamping piece, so that the control unit determines the position of the clamping piece according to the characteristics of reflected light.

In the feed module according to the embodiment of the present disclosure, the first sensor is an ultrasonic sensor, and faces the clamping piece. The ultrasonic sensor generates and transmits ultrasonic wave to the clamping piece and receives ultrasonic wave reflected by the clamping piece, so that the control unit determines the position of the clamping piece according to the characteristics of the reflected ultrasonic wave.

In the feed module according to the embodiment of the present disclosure, the first sensor is an optical scale, and includes: a mask, a grating scale and a sensing element. The mask is configured on the clamping piece so as to move along with the clamping piece. The grating scale is configured on the carrier tray, and the moving path of the mask is located between the clamping piece and the grating scale. The sensing element is configured on the mask to receive optical stripes generated by the grating scale via the mask, and the control unit determines the position of the clamping piece according to the characteristics of the optical stripes.

In the feed module according to the embodiment of the present disclosure, the document is suitable for being transferred into the multi-function product/printer/peripheral or printer along a first axial direction by the driving of the feed module, the clamping piece is suitable for moving along a second axial direction to clamp the document, the first axial direction is orthogonal to the second axial direction, and the width of the document is consistent to the second axial direction.

In the feed module according to the embodiment of the present disclosure, the first sensor and the clamping piece are jointly located in the second axial direction.

In the feed module according to the embodiment of the present disclosure, the feed module further includes a second sensor and a third sensor configured on the carrier tray along the first axial direction. The control unit is electrically connected with the second sensor and the third sensor. The document on the carrier tray shields or does not shield the second sensor and the third sensor, so that the second sensor and the third sensor respectively generate different sensing states. The control unit determines the length of the document according to the sensing states of the second sensor and the third sensor, and the length of the document is parallel to the first axial direction.

In the feed module according to the embodiment of the present disclosure, the feed module further includes a storage unit, which is electrically connected with the control unit and used for storing a comparison table. The comparison table includes a corresponding relation between the multiple sizes and specifications of document and the sensing states of the first sensor, the second sensor and the third sensor. The control unit determines the sizes and specifications of the document according to the sensing states of the first sensor, the second sensor and the third sensor and in contrast with the comparison table.

In the feed module according to the embodiment of the present disclosure, the control unit firstly determines the sizes and specifications of the document by the first sensor. When the determined size and specification are corresponding to at least two same results of the comparison table, the control unit determines unique size and specification of the document by integration according to the sensing states of the second sensor and the third sensor.

Based on the above, the document must be clamped and fixed by the clamping piece after being placed on the carrier tray, so that subsequent action of feeding is benefited. Accordingly, the feed module determines the position of the clamping piece on the carrier tray by the first sensor, so as to recognize the size and specification of the document placed on the carrier tray. Thus, the control unit determines the width of the document according to the sensing states of the first sensors, and the multi-function product/printer/peripheral or printer may timely determine the size and specification of the document before performing related processing action on the document, that is, after the clamping piece performs clamping action on the document, so that the multi-function product/printer/peripheral or printer proposes an operation means corresponding to the required data volume accordingly, so as to effectively increase the processing efficiency of the multi-function product/printer/peripheral or printer.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

FIG. 4 is a comparison table of the document sizes and specifications with sensors.

DESCRIPTION OF THE EMBODIMENTS

Figure 1:
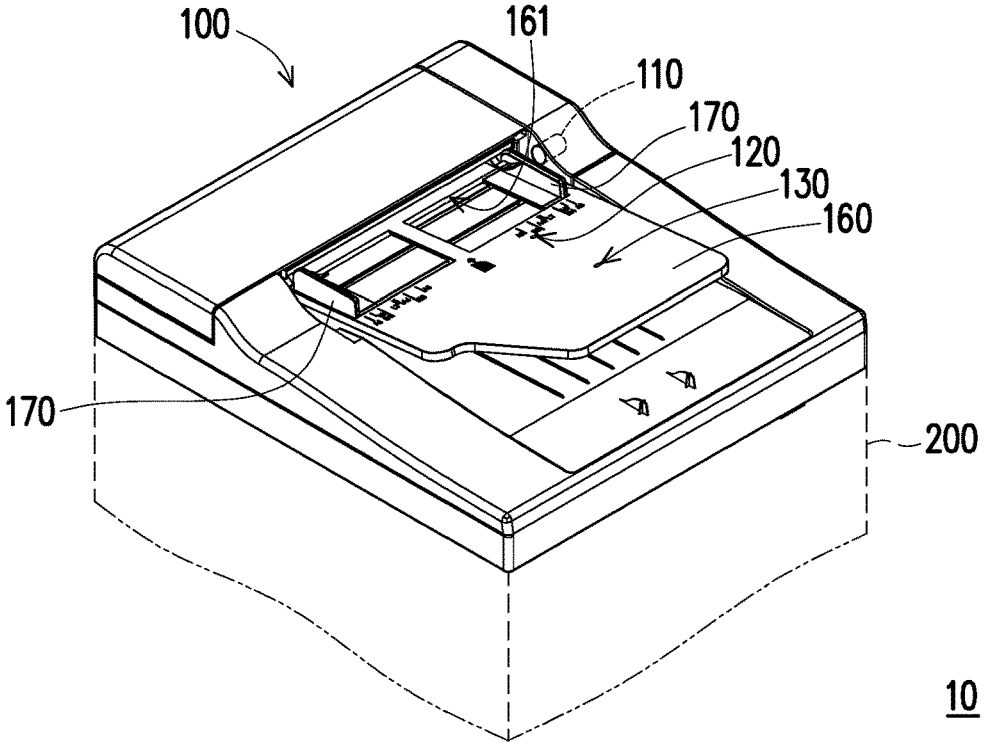
FIG. 1 is a simple schematic diagram of a multi-function product/printer/peripheral.

Reference will now be made in detail to the present preferred embodiments of the invention, examples of which are illustrated in the accompanying drawings. Wherever possible, the same reference numbers are used in the drawings and the description to refer to the same or like parts.

Figure 2:
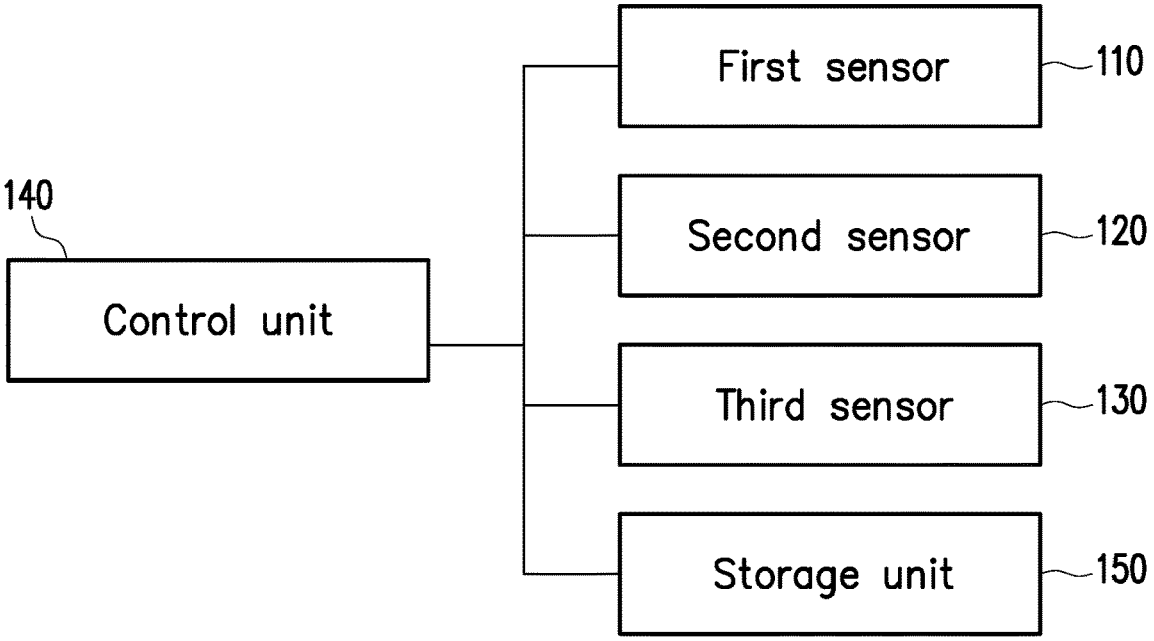
FIG. 2 is an electric relation diagram of part of components of the multi-function product/printer/peripheral.
Figure 3:
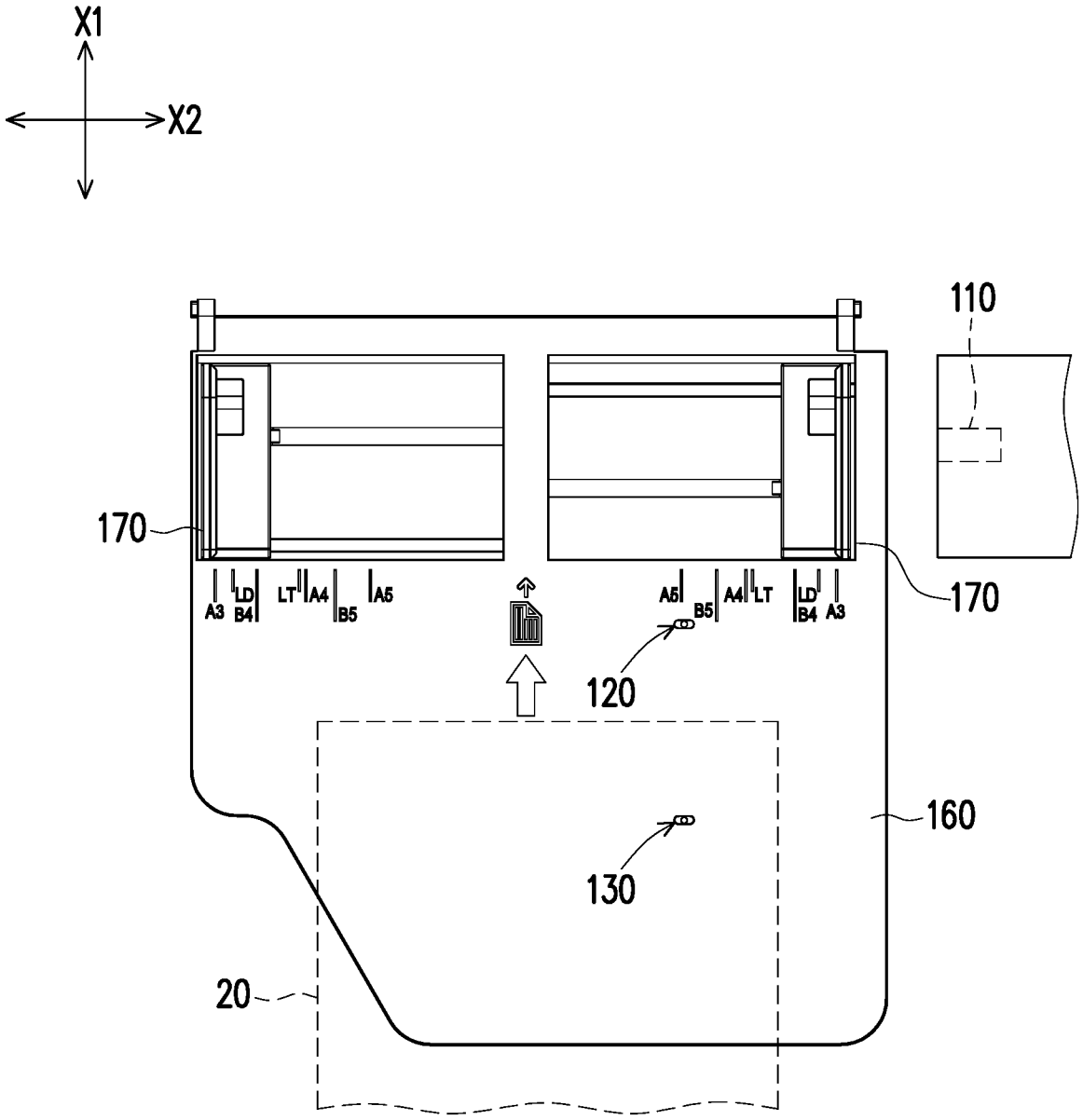
FIG. 3 is a top view of a feed module.

FIG. 1 is a simple schematic diagram of a multi-function product/printer/peripheral. FIG. 2 is an electric relation diagram of part of components of the multi-function product/printer/peripheral. FIG. 3 is a top view of a feed module. Please refer to FIG. 1 to FIG. 3 at the same time, in the present embodiment, the electronic device with a paper feeding function takes a multi-function product/printer/peripheral (MFP) as an example, the multi-function product/printer/peripheral 10 is known automation equipment for offices, integrates multiple functions such as copying, faxing, scanning and printing, and includes a cabinet 200 and a feed module 100 arranged on the cabinet 200; a document 20, i.e. paper, is suitable for being placed on a carrier tray 160 of the feed module 100, the carrier tray 160 has a first axial direction X1 and a second axial direction X2; the document 20 is driven by the feed module 100 (for example, a paper picking up roller, which is not shown herein) to be transferred into the multi-function product/printer/peripheral 10 along the first axial direction X1, and performs related document processing action under the driving of a processing module (not shown) arranged therein; and the first axial direction X1 is orthogonal to the second axial direction X2. The present embodiment does not show or mention the multi-function product/printer/peripheral herein and after, which may be already known from the prior art, and thus needs not to be further described.

Moreover, the feed module 100 further includes a first sensor 110, a control unit 140, a storage unit 150, a clamping piece 170 and the foregoing carrier tray 160, wherein the clamping piece 170 is movably arranged on the carrier tray 160 along the second axial direction X2, and includes a pair of components capable of moving opposite to each other, and the pair of components synchronously and relatively move close to or away from each other by a synchronizing mechanism (not shown), so that the document 20 located on the carrier tray 160 is suitable for being clamped and fixed by the clamping piece 170. The control unit 140 is electrically connected with the first sensor 110 and the storage unit 150, and the storage unit 150 is used for storing information related to the document 20 and the clamping piece 170. As what mentioned before, in order to let the feed module 100 to determine the size of the document 20 immediately once the document 20 is placed into the carrier tray 160, according to the present embodiment, the requirement is achieved by the first sensor 110, that is, the control unit 140 determines the size of the document 20 according to the sensing state of the first sensor 110 and related information of the storage unit 150.

In details, the first sensor 110 of the present embodiment is a distance sensor, especially an optical sensor configured at a feed inlet 161 of the carrier tray 160 and adjacent to the multi-function product/printer/peripheral 10 The first sensor 110 is composed of an element (not shown) for emitting light and an element (not shown) for sensing light arranged in a structure beside the carrier tray 160 as shown in FIG. 1, and faces a baffle structure of the clamping piece 170, that is, the first sensor 110 and the clamping piece 170 are jointly located in the second axial direction X2 substantially. Under the driving of the control unit 140, the first sensor 110 generates and transmits light to the clamping piece 170, and receives light reflected by the clamping piece 170. Thus, a relative distance between the clamping piece 170 and the first sensor 110 at the moment may be determined accordingly by utilizing a time difference in a light advancing process, so as to be compared with the related information of the storage unit 150.

For example, the storage unit 150 is used for storing a corresponding relation between the relative distance between the first sensor 110 and the clamping piece 170 and the position of the clamping piece 170 on the carrier tray 160, wherein the position of the clamping piece 170 on the carrier tray 160 represents the width of the document 20 at the moment, that is, the size of the document 20 along the second axial direction X2. Taking FIG. 3 as an example, with increase of the width of the document 20, the clamping piece 170 certainly moves outwards, so as to shorten the relative distance between the clamping piece 170 and the first sensor 110. On the contrary, with the reduction of the width of the document 20, the clamping piece 170 moves inwards, so as to increase the relative distance between the clamping piece 170 and the first sensor 110. Accordingly, the control unit 140 is capable of determining the width of the current document 20 by virtue of the relatively distance between the first sensor 110 and the clamping piece 170 sensed by the first sensor 110. That is, the control unit 140 is capable of judging the position of the clamping piece 170 on the carrier tray 160 according to the characteristics (light advancing time difference) of the reflected light.

What needs to be noted is that, the first sensor 110 of the present embodiment is configured on the right side of the carrier tray 160 as shown in FIG. 3, and therefore, the sensing object of the first sensor 110 is a component on the right side of the clamping piece 170, similarly, in other embodiments which are not shown, the first sensor can also be configured on the left side of the carrier tray, while the component on the left side of the clamping piece is taken as the sensing object.

In another embodiment, the first sensor 110 may also be an ultrasonic sensor facing the clamping piece 170, the first sensor 110 is controlled by the control unit 140 to generates and transmits ultrasonic wave to the clamping piece 170 and receives ultrasonic wave reflected by the clamping piece 170, so that the control unit 140 determines the position of the clamping piece 170 on the carrier tray 160 according to the characteristics (for example, the ultrasonic wave advancing time difference) of the reflected ultrasonic wave.

Furthermore, FIG. 4 is a comparison table of the document sizes and specifications with sensors. Please refer to FIG. 3 and FIG. 4 at the same time, the feed module 100 of the present embodiment further includes a second sensor 120 and a third sensor 130, which are both configured on the carrier tray 160 along the first axial direction X1 and are respectively electrically connected to the control unit 140. The document 20 on the carrier tray 160 causes the second sensor 120 and the third sensor 130 to respectively generate different sensing states by shielding or not shielding the second sensor 120 and the third sensor 130, so that the control unit 140 determines the length of the document 20, which is the size of the document 20 along the first axial direction X1, according to the sensing states of the second sensor 120 and the third sensor 130.

That is, the storage unit 150 of the present embodiment is also used for storing the comparison table as shown in FIG. 4, and the comparison table includes a corresponding relation between multiple sizes and specification of the documents 20 and the sensing states of the first sensor 110, the second sensor 120 and the third sensor 130. Then, the control unit 140 is capable of judging the size and specification of the document 20 according to the sensing states of the first sensor 110, the second sensor 120 and the third sensor 130 and by comparing with the comparison table of FIG. 4.

As shown in FIG. 4, what are shown in the column is the specification of the document 20 and the feeding mode thereof, for example, A3 SEF represents that the document 20 is of the specification of A3, and is fed in a mode of short edge feed (SEF), that is, the size of the document 20 at the moment is 297 mm×420 mm, and the placement orientation on the carrier tray 160 enables that 297 mm is taken as the size along the second axial direction X2, and 420 mm is taken as the size along the first axial direction X1. A4 LEF shown on the right of the reference table represents that the size and dimension of the document 20 is 297 mm×210 mm, and the document 20 is placed on the carrier tray 160 in a mode of long edge feed (LEF). Modes of other sizes and dimensions of the document 20 are listed on FIG. 4, and are not further described herein.

Taking the document 20 which is B6 SEF as an example, after the document 20 is placed on the carrier tray 160 and clamped and fixed by the clamping piece 170, the first sensor 110 as shown in FIG. 1 to FIG. 3 is used in match, and the first sensor 110 is capable of sensing that the relative distance between the first sensor 110 and the clamping piece 170 is 106.5 mm, and therefore, the control unit 140 determines that the specification of the document 20 at the moment is B6 SEF according to the relative distance sensed by the first sensor 110 and by comparing with the information listed in FIG. 4.

Furthermore, the document 20 with the specifications of A3 SEF or A4 LEF is taken as an example, the first sensor 110 as shown in FIG. 1 to FIG. 3 is used in match, and after the document 20 is placed into the carrier tray 160 and is clamped and fixed by the clamping piece 170, the first sensor 110 senses that the relative distance between the first sensor 110 and the clamping piece 170 at the moment is 20.5 mm. However, as listed in the comparison table, two possible corresponding document specifications, namely A3 SEF and A4 LEF, exist, and therefore, the feed module 100 needs to further perform integration judgement by utilizing the sensing states of the second sensor 120 and the third sensor 130. As shown in the comparison table, the document with specification of A4 LEF only shields the second sensor 120, and cannot shield the third sensor 130 (the black points listed in the table represent that the document 20 shields the corresponding sensor, and there is no black point listed to represent the sensor is not shielded by the document 20), and therefore, if the foregoing situation exists currently, the unique size and specification of the document 20 at the moment is A4 LEF. Correspondingly, if the document 20 at the moment shields the second sensor 120 and the third sensor 130 at the same time, the unique size and specification of the document 20 at the moment is A3 SEF. According to the logic, the control unit 140 determines and determines the size and specification of the document 20 on the carrier tray 160 by the sensing states of the first sensor 110, the second sensor 120 and the third sensor 130 and by comparing with the comparison table of the storage unit 150.

Figure 5:
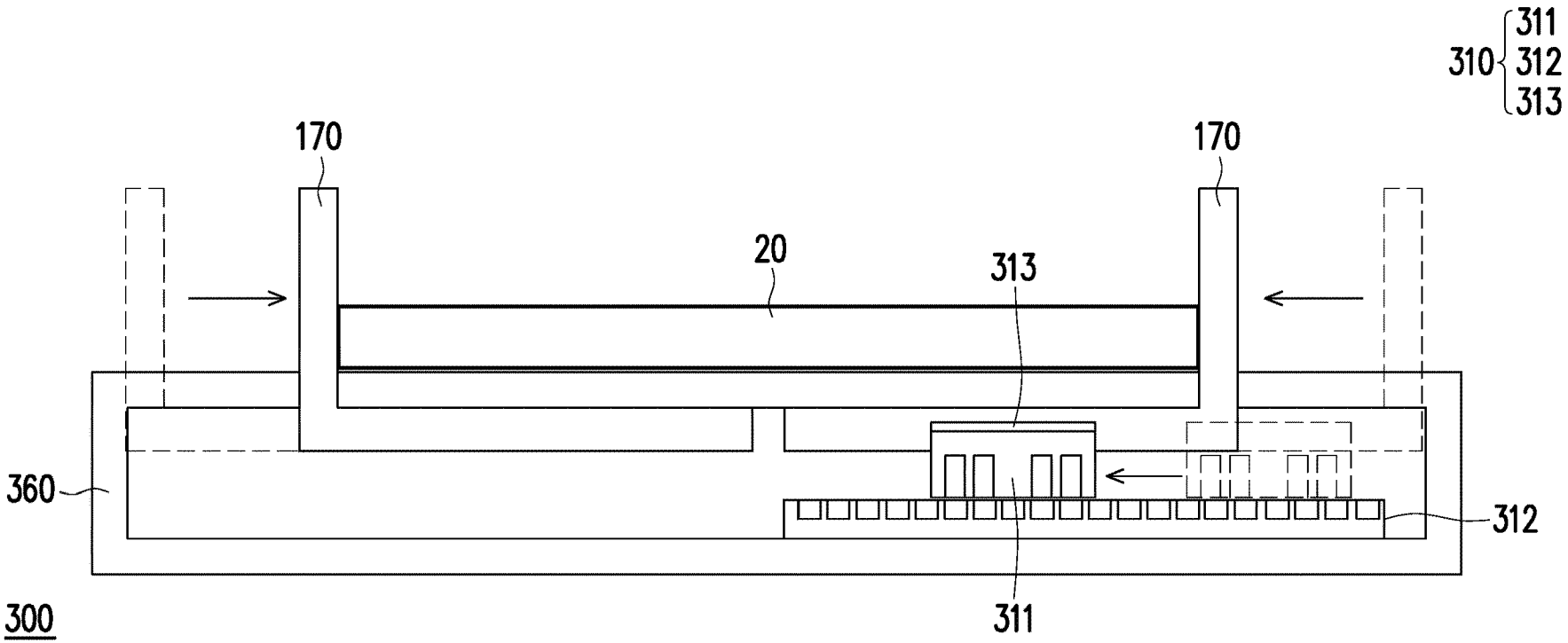
FIG. 5 is a schematic diagram of a feed module according to another embodiment.

FIG. 5 is a schematic diagram of a feed module according to another embodiment. Please refer to FIG. 5, the difference from the foregoing embodiment is that, in the feed module 300 of the present embodiment, the first sensor 310 is an optical scale, and includes a mask 311, a grating scale 312 and a sensing element 313, wherein the mask 311 is configured on the clamping piece 170 so as to move along with the clamping piece 170; the grating scale 312 is configured on the carrier tray 360, and the moving path of the mask 311 is located between the clamping piece 170 and the grating scale 312; and the sensing element 313 is configured on the mask 311, and is configured to receive optical stripes generated by the grating scale 312 via the mask 311. It may be known from FIG. 5 that, along with the change of position of the clamping piece 170 on the carrier tray 360, the optical stripes sensed by the sensing element 313 change accordingly, and therefore, the control unit 140 is capable of judging the position of the clamping 170 on the carrier tray 360 currently according to the characteristics of the optical stripes, so as to successfully determine the size and specification of the document 20.

Figure 6:
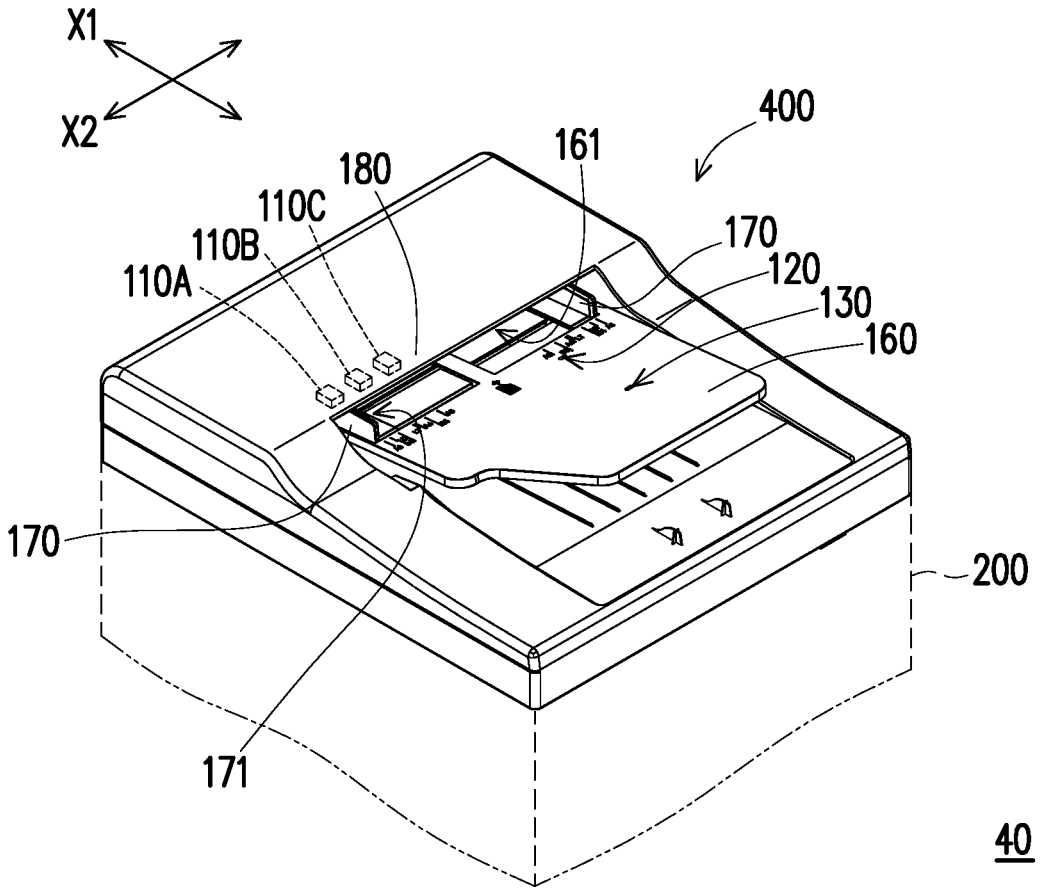
FIG. 6 is a simple schematic diagram of a multi-function product/printer/peripheral according to another embodiment.

FIG. 6 is a simple schematic diagram of a multi-function product/printer/peripheral according to another embodiment. Please refer to FIG. 6, in the multi-function product/printer/peripheral 40 of the present embodiment, the feed module 400, similar to the foregoing embodiment, is arranged on the cabinet 200 to send the document (not shown, please refer to the foregoing embodiment) to the multi-function product/printer/peripheral 40 via the feed inlet 161. Similar to the foregoing embodiment, the document 20 (shown in the foregoing embodiment) is transferred into the multi-function product/printer/peripheral 40 along the first axial direction X1, the clamping piece 170 moves along the second axial direction X2 to clamp the document 20, the first axial direction X1 is orthogonal to the second axial direction X2, the width of the document 20 is consistent to the second axial direction X2, and the arrangement directions of the first sensors 110A, 110B and 110C are parallel to the second axial direction X2.

While the difference is that, the feed module 400 of the present embodiment includes a plurality of first sensors 110A, 110B and 110C, which are arranged beside the feed inlet 161, in particular, the first sensors 110A, 110B and 110C are located at an eave structure 180 of the feed module 400 (located beside the feed inlet 161, especially, located above the feed inlet 161), and respectively face the moving path of the clamping piece 170, that is, the clamping piece 170 will pass below the first sensors 110A, 110B and 110C. Further, the first sensors 110A, 110B and 110C are optical sensors, and generate a first signal and a second signal accordingly by sensing the light change, and it is defined here that the sensor generates the first signal when sensing the reflected light (that is, a shelter exists in front of the sensor), which is marked as "1" subsequently, and generates the second signal when not sensing the reflected light (that is, no shelter exists in front of the sensor), which is marked as "0" subsequently. In the present embodiment, the clamping piece 170 shields the first sensors 110A, 110B and 110C by the side wall top portion 171.

Based on the above, along with the movement of the clamping piece 170 to different position by adapting to documents 20 of different widths, the sensing state of shielding or not shielding will be generated to the first sensors 110A, 110B and 110C, so that the control unit 140 determines the width of the document 20 according to the sensing states of the first sensors 110A, 110B and 110C.

Furthermore, the multi-function product/printer/peripheral 40 of the present embodiment similarly includes a second sensor 120 and a third sensor 130, which have already been mentioned in the foregoing embodiment, and thus are not further described herein.

To sum up, the subsequent feeding action is benefited only by clamping and fixing the document with the clamping piece after the document is placed on the carrier tray. Accordingly, the feed module determines the position of the clamping piece on the carrier tray by the first sensor, so as to recognize the size and specification of the document placed on the carrier tray, in particular, recognize the width of the document, wherein the first sensor may be an optical sensor, an ultrasonic sensor or an optical scale, and is used for obtaining the relative distance (position) relation between the first sensor and the clamping piece, so as to obtain the width of the document. Furthermore, the feed module also obtains information related to the length of the document by the sensing states of the second sensor and the third sensor, and then the control unit integrates and determines the sensing results of the first sensor, the second sensor and the third sensor, so as to more precisely determine the size and specification of the document.

Thus, the electronic device with the paper feeding function, for example, the multi-function product/printer/peripheral or printer and the like may timely determine the size and specification of the document before performing related processing action on the document, that is, after the clamping piece performs the clamping action on the document, so that the electronic device proposes an operation means corresponding to the needed data volume accordingly, so as to effectively increase the processing efficiency of the electronic device.

Finally, it should be noted that the foregoing embodiments are merely intended for describing the technical solutions of the present invention, but not for limiting the present invention. Although the present invention is described in detail with reference to the foregoing embodiments, persons of ordinary skill in the art should understand that they may still make modifications to the technical solutions described in the foregoing embodiments or make equivalent replacements to some or all technical features thereof, without departing from the scope of the technical solutions of the embodiments of the present invention.

What is claimed is:

1. A feed module, being disposed to an electronic device with a paper feeding function, wherein the feed module comprises:

a carrier tray, comprising a feed inlet adjacent to the electronic device, a document is suitable for being placed on the carrier tray, and is driven by the feed module to be transferred into the electronic device via the feed inlet;

a clamping piece, movably assembled on the carrier tray;

at least one first sensor, located beside the feed inlet and sensing the position of the clamping piece on the carrier tray; and a control unit, electrically connected with the first sensor, judging the width of the document by the at least one first sensor after the document being placed on the carrier tray and clamped by the clamping piece, wherein the first sensor is an optical scale, comprising:

a mask, configured on the clamping piece so as to move along with the clamping piece;

a grating scale, configured on the carrier tray, wherein the moving path of the mask is located between the clamping piece and the grating scale; and a sensing element, configured on the mask to receive optical stripes generated by the grating scale via the mask, wherein the control unit determines the position of the clamping piece according to the characteristics of the optical stripes.

2. The feed module according to claim 1, wherein the document is suitable for being transferred into the electronic device along a first axial direction by the driving of the feed module, the clamping piece is suitable for moving along a second axial direction to clamp the document, the first axial direction is orthogonal to the second axial direction, and the width of the document is consistent to the second axial direction.

3. The feed module according to claim 2, wherein the first sensor and the clamping piece are jointly located in the second axial direction.

4. The feed module according to claim 2, further comprising:

a second sensor and a third sensor, configured on the carrier tray along the first axial direction, wherein the control unit is electrically connected with the second sensor and the third sensor, and the document on the carrier tray shields or does not shield the second sensor and the third sensor, so that the second sensor and the third sensor respectively generate different sensing states, the control unit determines the length of the document according to the sensing states of the second sensor and the third sensor, and the length of the document is parallel to the first axial direction.

5. The feed module according to claim 4, further comprising:

a storage unit, electrically connected with the control unit for storing a comparison table, wherein the comparison table comprises a corresponding relation between the multiple sizes and specifications of document and the sensing states of the first sensor, the second sensor and the third sensor, and the control unit determines the sizes and specifications of the document according to the sensing states of the first sensor, the second sensor and the third sensor and in contrast with the comparison table.

6. The feed module according to claim 5, wherein the control unit firstly determines the sizes and specifications of the document by the first sensor, and when the determined size and specification are corresponding to at least two same results of the comparison table, the control unit determines unique size and specification of the document by integration according to the sensing states of the second sensor and the third sensor.

7. The feed module according to claim 1, wherein the feed module comprises a plurality of first sensors, the first sensors face the moving path of the clamping piece, the first sensors generate different sensing states according to being shielded or not shielded by the clamping piece, and the control unit determines the width of the document according to the sensing states of the first sensors.

8. The feed module according to claim 7, wherein the document is suitable for being transferred into the electronic device along the first axial direction by the driving of the feed module, the clamping piece is suitable for clamping the document along the second axial direction, the first axial direction is orthogonal to the second axial direction, the width of the document is consistent to the second axial direction, and the arrangement direction of the first sensors is parallel to the second axial direction.

* * * * *